US011396405B2

(12) United States Patent
Messerle

(10) Patent No.: US 11,396,405 B2
(45) Date of Patent: Jul. 26, 2022

(54) PACKAGING, ESPECIALLY FOR FOOD

(71) Applicant: Messerle GmbH, Mader (AT)

(72) Inventor: Heiner Messerle, Hochst (AT)

(73) Assignee: Messerle GmbH, Mader (AT)

( * ) Notice: Subject to any disclaimer, the term of this patent is extended or adjusted under 35 U.S.C. 154(b) by 0 days.

(21) Appl. No.: 16/810,111

(22) Filed: Mar. 5, 2020

(65) Prior Publication Data

US 2020/0283202 A1 Sep. 10, 2020

(30) Foreign Application Priority Data

Mar. 5, 2019 (AT) ..... A 81/2019

(51) Int. Cl.
*B65D 43/02* (2006.01)
*B65D 8/00* (2006.01)

(52) U.S. Cl.
CPC ..... *B65D 43/0212* (2013.01); *B65D 15/22* (2013.01); *B65D 2543/00194* (2013.01); *B65D 2543/00296* (2013.01); *B65D 2543/00361* (2013.01); *B65D 2543/00527* (2013.01); *B65D 2543/00537* (2013.01); *B65D 2543/00712* (2013.01)

(58) Field of Classification Search
CPC ..... B65D 43/0212; B65D 15/22; B65D 43/0204; B65D 2543/00194
See application file for complete search history.

(56) References Cited

U.S. PATENT DOCUMENTS 3,034,693 A 5/1962 Cox
3,217,963 A 11/1965 Alsman
4,272,010 A * 6/1981 Capo ..... B65D 77/2012 229/125.27
4,375,862 A 3/1983 Kurinsky et al.
2018/0303260 A1* 10/2018 Vukkisila ..... A47G 19/30

FOREIGN PATENT DOCUMENTS

| | | |
|---|---|---|
| DE | 29515650 | 11/1995 |
| EP | 0169737 | 1/1986 |
| FR | 2589443 | 5/1987 |
| WO | 8702008 | 4/1987 |

* cited by examiner

*Primary Examiner* — Jeffrey R Allen
(74) *Attorney, Agent, or Firm* — Volne Koenig

(57) ABSTRACT

A packaging, especially for food, including a cardboard shell and a cover placed thereon in the closed state and which engages over the outside of an upper edge of the shell. Inwardly protruding nubs arranged at at least two opposing side walls of the cover interact with retaining elements at associated side walls of the shell. The side walls having the retaining elements each have a wall portion which is connected to the bottom of the shell by a bend, a first reinforcing portion connected to the upper end of the wall portion by a bend, a second reinforcing portion connected to the first reinforcing portion by a bend and an adhesive-secured portion connected to the second reinforcing portion by a bend and which is adhesively bonded to the outer side of the wall portion. A sub-portion of the wall portion that lies above the adhesive-secured portion, and the first and second reinforcing portions delimit a triangular channel. The retaining elements are formed by edges of openings in or by downwardly directed outer surfaces of the second reinforcing portions.

8 Claims, 6 Drawing Sheets

PACKAGING, ESPECIALLY FOR FOOD

INCORPORATION BY REFERENCE

The following documents are incorporated herein by reference as if fully set forth: Austrian Patent Application No. A 81/2019, filed Mar. 5, 2019.

TECHNICAL FIELD

The invention relates to a packaging, especially for food, comprising a shell made of cardboard or paperboard and a cover which is placed onto the shell in the closed state of the packaging and which engages over the outside of an upper edge of the shell, inwardly protruding nubs arranged at at least two side walls of the cover interacting with retaining elements arranged at associated side walls of the shell.

BACKGROUND

Packaging for food, for example cakes, baked goods, ready-made meals or salad, comprised of a shell made of plastic and an in particular hat-shaped cover made of plastic which is placed onto said shell is known, the cover having protruding nubs which interact with retaining elements of the shell. At least the plastic of the cover, optionally also the plastic of the shell, may be of transparent design. Packaging of this kind is also referred to as blister packaging.

In order to reduce the amount of plastic, it has already been proposed for the shell to be formed of cardboard or paperboard. However, "hybrid" packaging of this kind which is already known is disadvantageous in various respects, in particular with regard to the handling and/or the stability and/or the hold of the placed-on cover on the shell.

SUMMARY

It is an object of the invention to provide an advantageous packaging of the kind mentioned in the introduction which is easy to handle and can be formed with good stability. This is achieved by a packaging having one or more features of the invention.

In the case of the packaging according to the invention, side walls of the shell having retaining elements for the purposes of interacting with inwardly protruding nubs of the cover each have a wall portion which is connected to the bottom of the shell by way of a bend, a first reinforcing portion connected to the upper end of the wall portion by way of a bend, a second reinforcing portion connected to the first reinforcing portion by way of a bend and an adhesive-secured portion which is connected to the second reinforcing portion by way of a bend and which is adhesively bonded to the outer side of the wall portion. A sub-portion of the wall portion that lies above the adhesive-secured portion, the first reinforcing portion and the second reinforcing portion together delimit a channel which is triangular as seen in cross section. The retaining elements for the nubs are formed by edges of openings in the second reinforcing portions or by the downwardly directed outer surfaces of the second reinforcing portions.

In the case of a shell configured in accordance with the invention, the cover connected to the shell can be provided with very good hold, specifically in particular due to the stability of the regions in which the retaining elements for the nubs of the cover are arranged.

Preferably, at least two opposing side walls of the cover have inwardly protruding nubs which interact with retaining elements arranged at opposing side walls of the shell. One embodiment which is advantageous in terms of production makes provision for inwardly protruding nubs of this kind to be provided only at two opposing side walls of the cover and for the shell to accordingly have retaining elements arranged only at two opposing side walls, said retaining elements interacting with the nubs of the cover.

One expedient configuration makes provision for each of the second reinforcing portions to have at least two openings which are spaced apart from one another in the direction of the longitudinal extent of the respective channel and into which a respective nub of the cover engages.

A shell of the packaging configured in accordance with the invention can advantageously be folded out from a flat blank made of cardboard or paperboard and adhesively bonded. Simple and effective production can be made possible as a result.

The mass per unit area of the cardboard or of the paperboard, of which the shell is formed, is in particular more than 150 g/m$^2$. Above such a mass per unit area, reference is generally made to cardboard. At a mass per unit area above 225 g/m$^2$, sometimes even only above 300 g/m$^2$, reference is typically made to paperboard.

The cardboard or the paperboard of which the shell is comprised is advantageously of multilayer configuration.

It can be solid cardboard or solid paperboard or corrugated cardboard or corrugated paperboard.

In the case of the flat blank made of cardboard or paperboard, in one possible embodiment of the invention, side walls which succeed one another in the circumferential direction of the shell can be connected to one another by way of connecting portions which, when the shell is in the folded-out and adhesively bonded state, are adhesively bonded to at least one of the successive side walls. Such connecting portions can each have a first and a second triangular portion. When the blank of the shell is in the flatly laid-out state, the first and the second triangular portion can each adjoin the respectively adjacent side wall by way of a bending line, said bending line proceeding from that corner of the bottom at which the respective connecting portion is arranged. The first and the second connecting portion are then subsequently separated from one another by way of a bending line which proceeds from the corner of the bottom and which is at an angle of 135° with respect to the respective one of the two side edges of the bottom which together form the corner. During the folding-out of the shell from the blank, the first and second triangular portions of the respective connecting portion are folded together, then folded back toward one of the adjacent side walls and adhesively bonded thereto.

The bending lines of the blank, at which the latter is bent during the folding-out of the shell, can be configured in the form of crease lines (formed by creases in the cardboard or in the paperboard) or in the form of perforation lines (formed by perforations in the cardboard or in the paperboard).

The cover, which is preferably comprised of an in particular transparent plastic, for example PET, advantageously has a widened lower base portion which, by way of gradations at least of the side walls of the cover having the nubs, adjoins that part of the cover which lies thereabove. In this case, at least two opposing gradations of the cover rest on the upper sides of the first reinforcing portions of the opposing side walls of the shell.

BRIEF DESCRIPTION OF THE DRAWINGS

Further advantages and details of the invention will be elucidated below on the basis of the attached drawing, in which.

Figure 2:
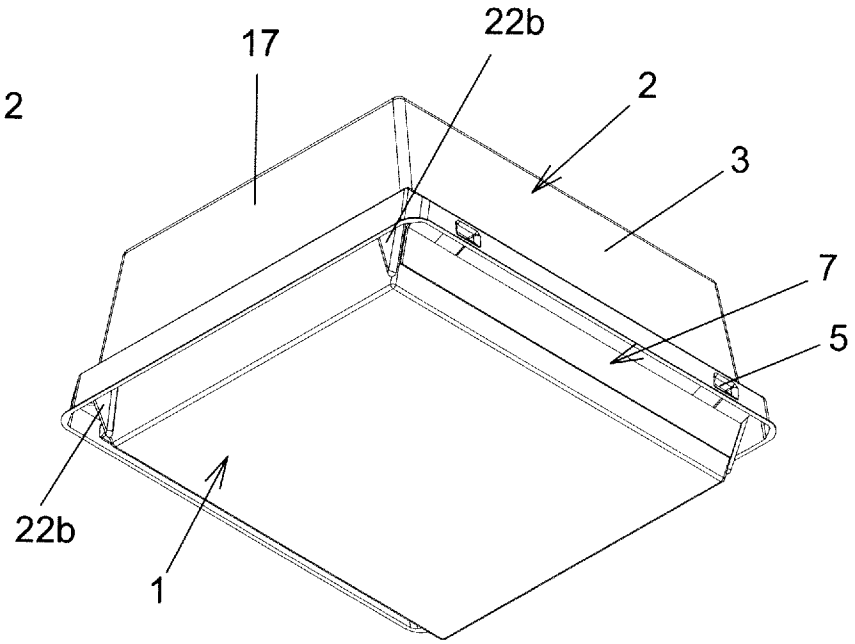
FIGS. 1 and 2 show oblique views of one exemplary embodiment of a packaging according to the invention in the assembled state of the shell and the cover.
Figure 1:
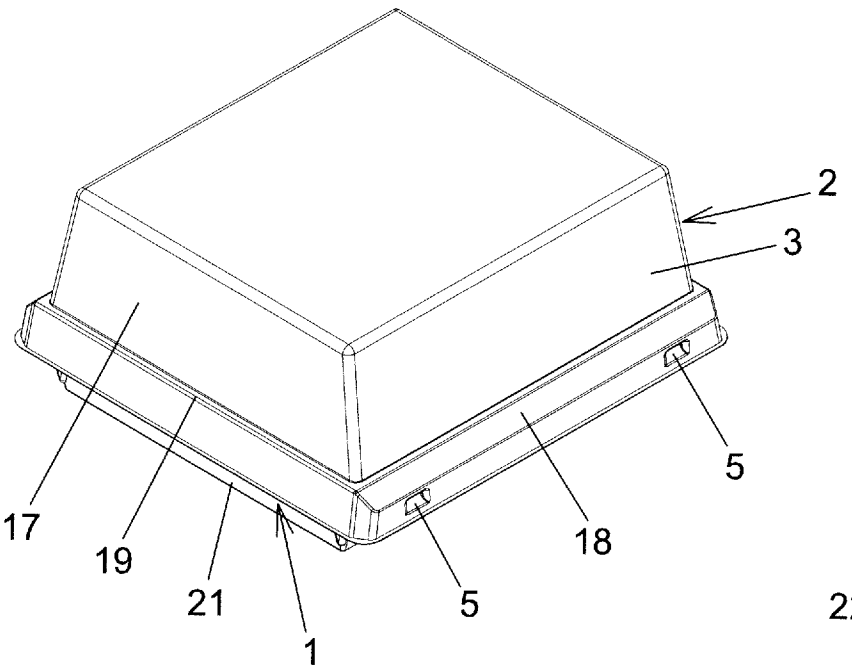
Figure 5:
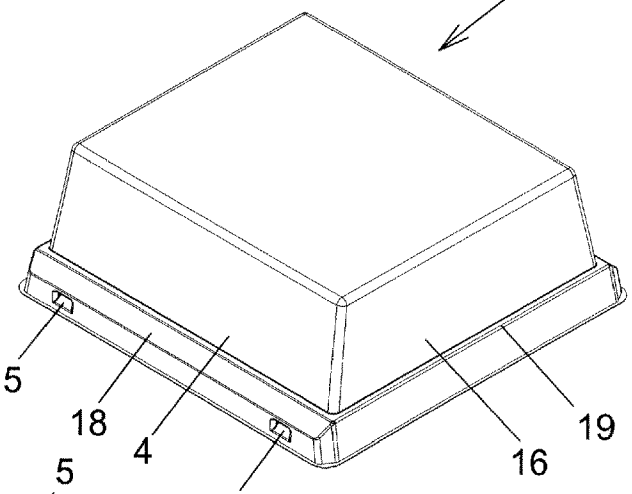
FIGS. 5 and 6 show oblique views of the cover of the packaging from various viewing directions.
Figure 6:
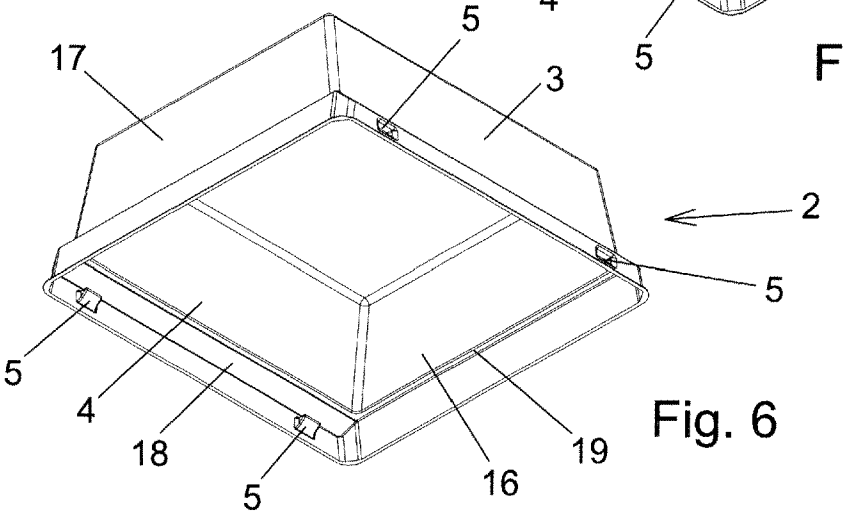
Figure 3:
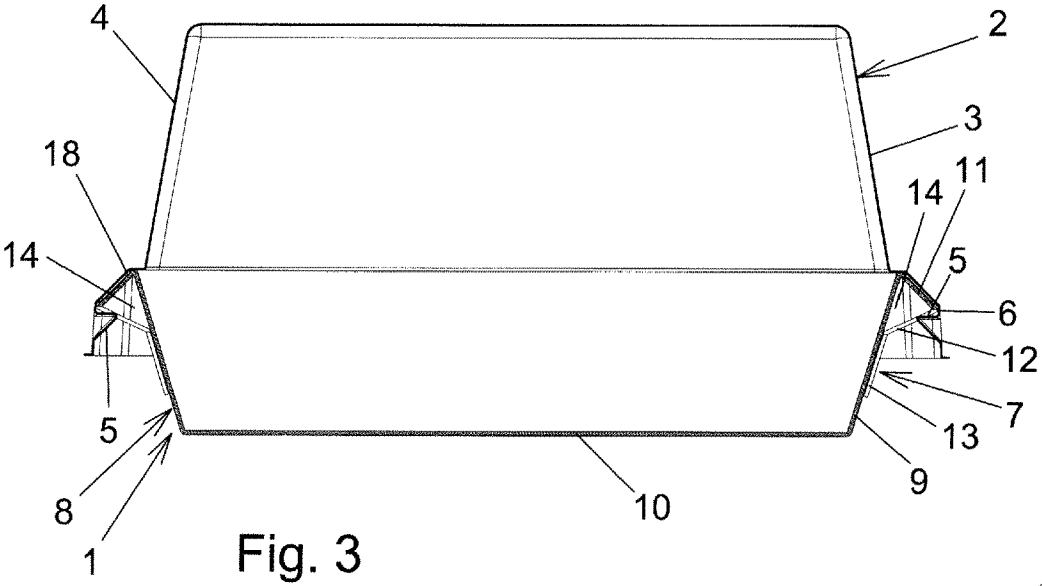
FIG. 3 shows a vertical section through the packaging in the assembled state.
Figure 4:
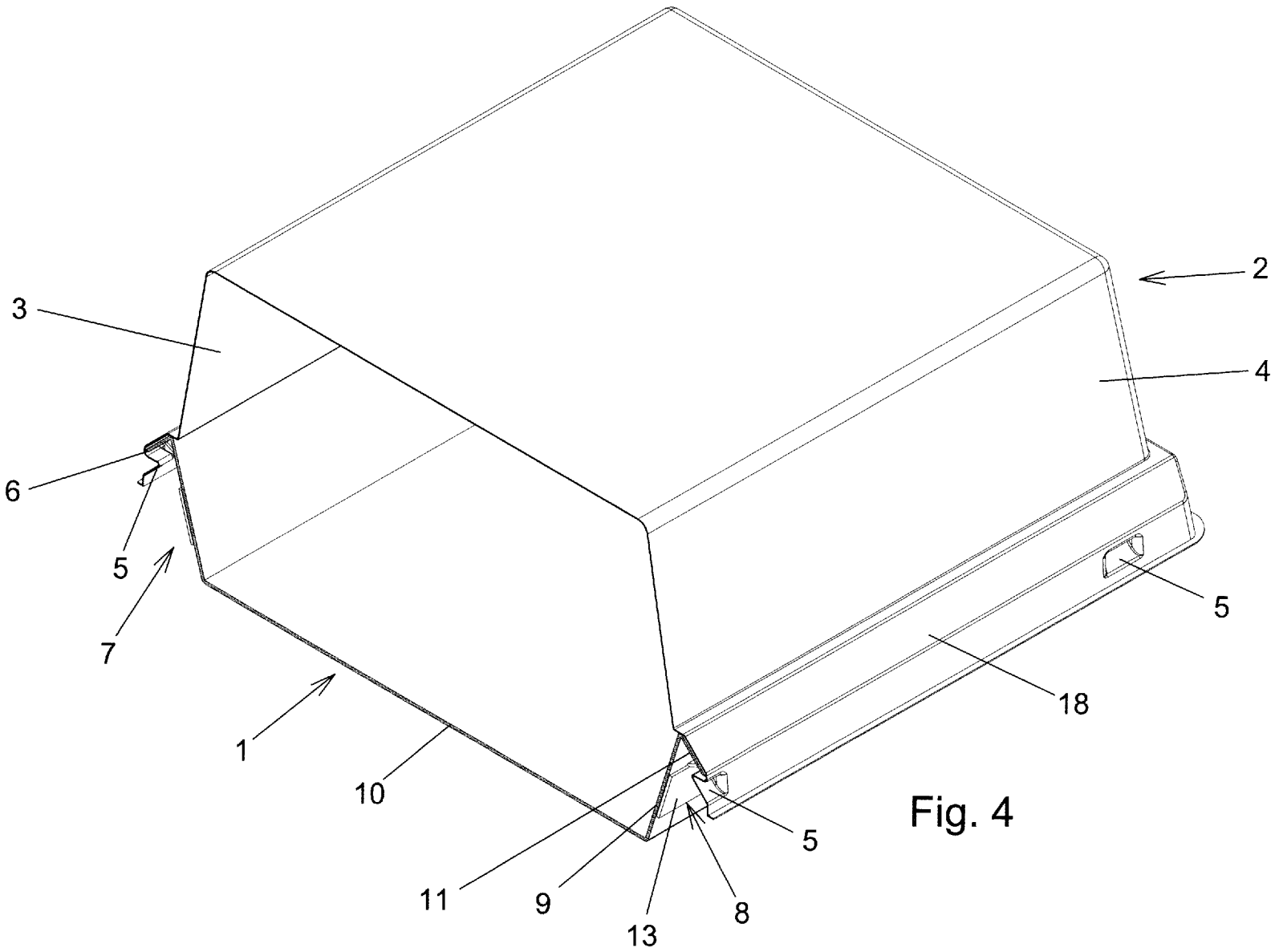
FIG. 4 shows a corresponding vertical section in an oblique view.
Figure 9:
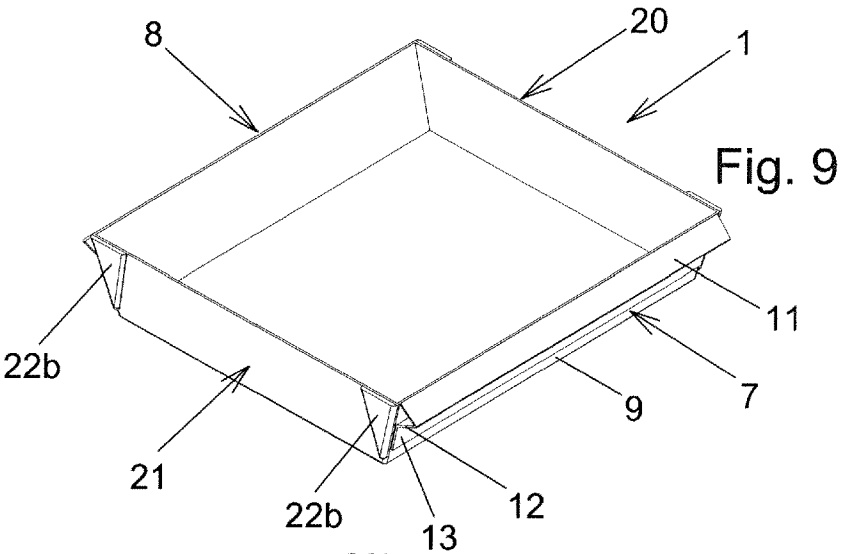
FIGS. 9 and 10 show oblique views of the shell of the packaging from various viewing directions.
Figure 10:
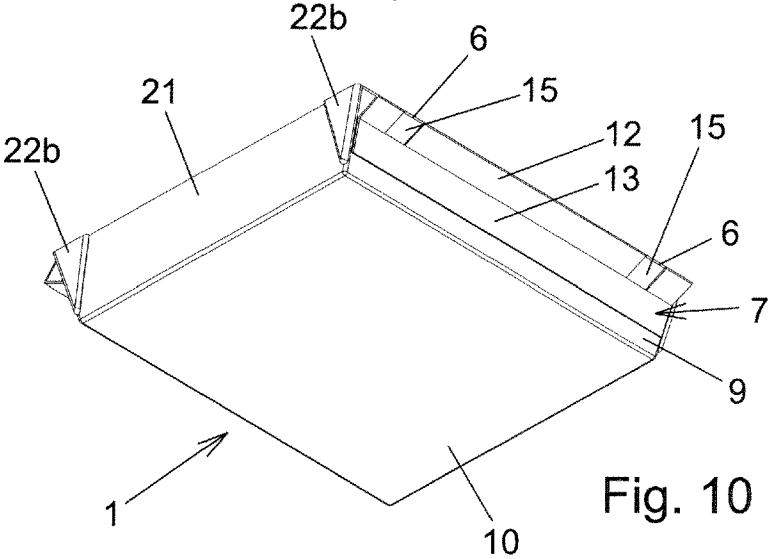
Figure 7:
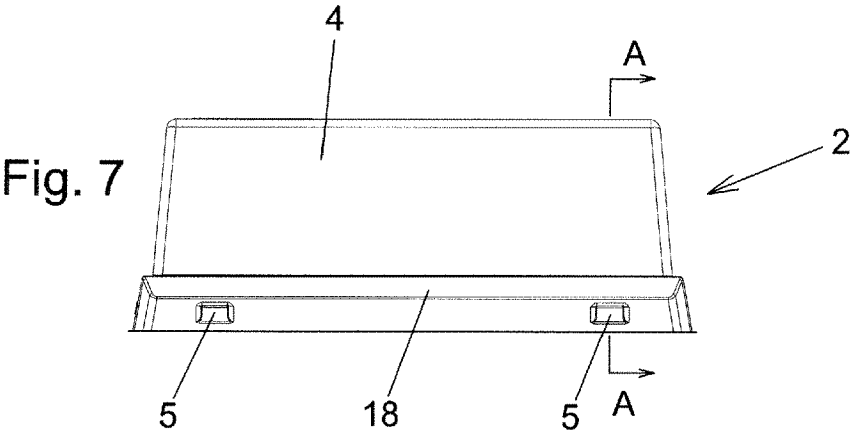
FIG. 7 shows a side view of the cover.
Figure 8:
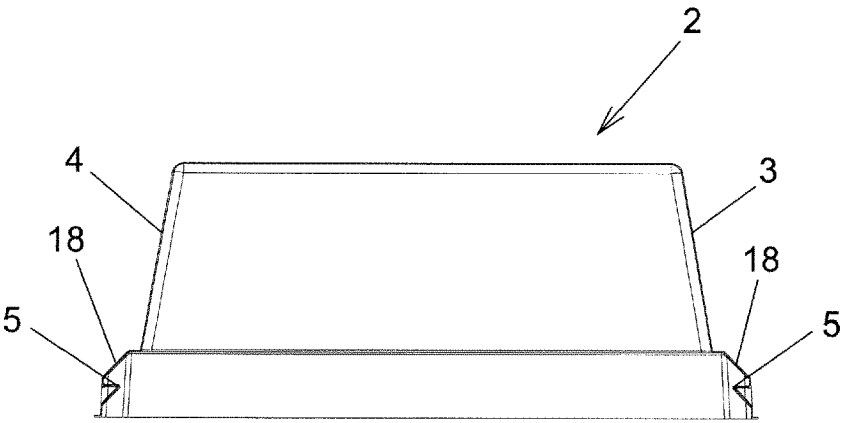
FIG. 8 shows a section along the line AA of FIG. 7.
Figure 12:
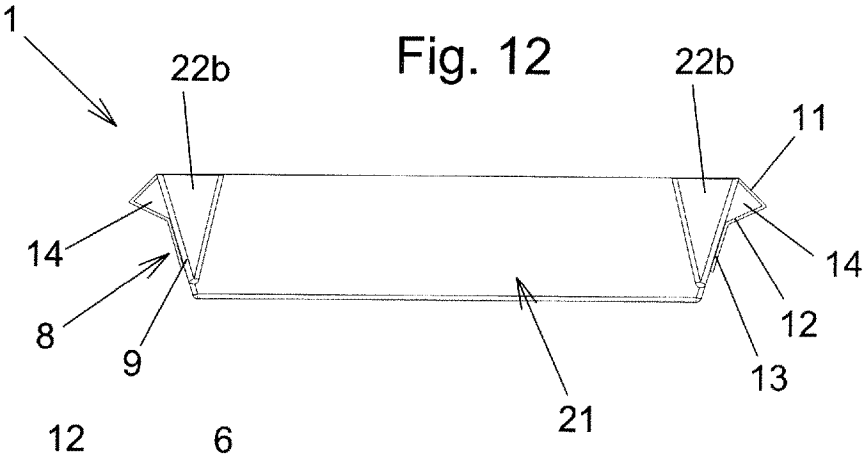
FIGS. 11 and 12 show side views of the shell.
Figure 11:
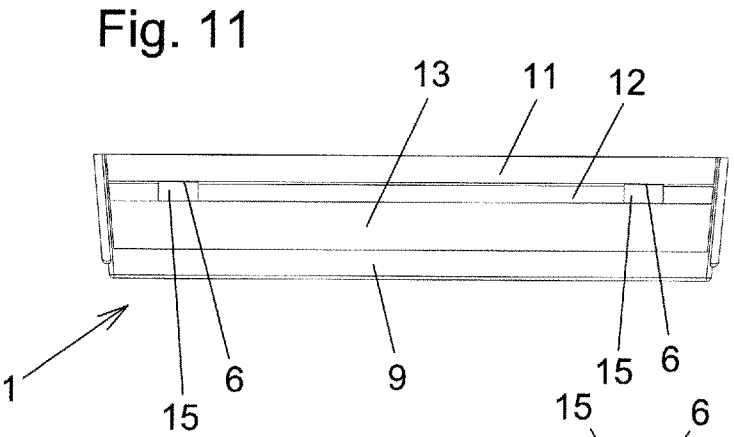
Figure 13:
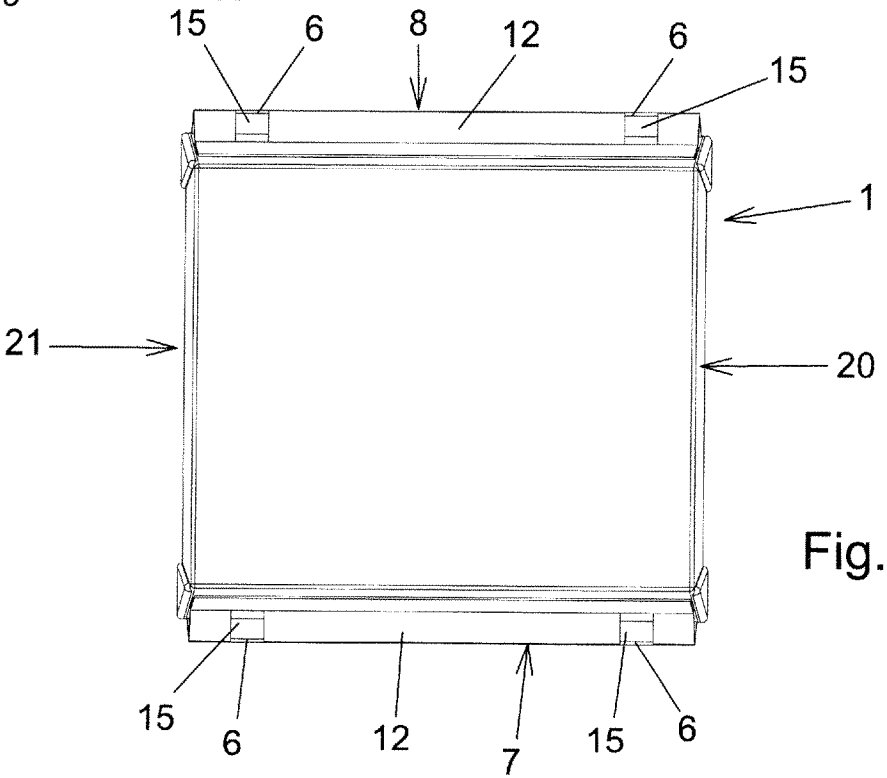
FIG. 13 shows a view of the shell from below.

The figures have different scales.

DETAILED DESCRIPTION

One exemplary embodiment of the invention will be elucidated below on the basis of FIGS. 1 to 14. The packaging is formed by a shell 1 made of cardboard or paperboard and a cover 2 made of preferably transparent plastic, for example PET. The cover 2 can be connected to the shell 1 by way of a snap-in connection. For this purpose, the cover 2 has in each case two inwardly protruding nubs 5 at two opposing side walls 3, 4. In the state when the cover 2 has been placed onto the shell 1, the cover 2 engages over the outside of an upper edge of the shell 1, the nubs 5 interacting with retaining elements 6 arranged at two opposing side walls 7, 8 of the shell 1.

The opposing side walls 7, 8 of the shell 1 having the retaining elements 6 each have a wall portion 9 which is connected to the bottom 10 of the shell 1 by way of a bend, the wall portion 9 enclosing an angle lying in the range of 90° to 135° with the bottom 10. Preferably, said angle lies in the range of 90° to 110°, in the exemplary embodiment at approximately 105°.

A first reinforcing portion 11 is connected to the upper end of the wall portion 9 by way of a bend, the wall portion 9 enclosing an angle in the range of 30° to 150°, preferably in the range of 45° to 135°, in the exemplary embodiment of approximately 60°, with the first reinforcing portion 11. In this case, the first reinforcing portion 11 extends outwardly toward that end thereof which is remote from the wall portion 9.

A second reinforcing portion 12 is connected to that end of the first reinforcing portion 11 which is remote from the wall portion 9 by way of a bend, the first reinforcing portion 11 enclosing an angle in the range of 20° to 120°, preferably 45° to 90°, in the exemplary embodiment of approximately 70°, with the second reinforcing portion 12. The second reinforcing portion 12 runs from that end of the first reinforcing portion 11 which is remote from the upper end of the wall portion 9 as far as the outer side of the wall portion 9. An adhesive-secured portion 13 is connected by way of a bend to said end of the second reinforcing portion 12 which adjoins the outer side of the wall portion 9, the second reinforcing portion 12 enclosing an angle in the range of 80° to 160°, preferably 90° to 145°, in the exemplary embodiment of approximately 135°, with the adhesive-secured portion 13. The adhesive-secured portion 13 runs, from the end thereof which is connected to the second reinforcing portion 12, in a downward direction and is adhesively bonded, preferably over the entire extent thereof, to the outer side of the wall portion 9.

In this way, a respective channel 14 is formed, which is delimited by way of a sub-portion of the wall portion 9 that lies above the adhesive-secured portion 13, the first reinforcing portion 11 and the second reinforcing portion 12. The channel 14 has a triangular cross section, that is to say, in the vertical cross section through the shell, that sub-portion of the wall portion 9 which lies above the adhesive-secured portion 13, the first reinforcing portion 11 and the second reinforcing portion 12 lie on the sides of a triangle.

The channels 14 run horizontally, preferably over the entire longitudinal extents of the opposing side walls 7, 8.

By virtue of this configuration, the opposing side walls 7, 8 are substantially reinforced, in particular in the regions in which the channels 14 are formed.

In order to form the retaining elements 6, the second reinforcing portions 12 have openings 15 which are configured in the form of window apertures. Such an opening 15 is provided for each of the nubs 5, therefore, in the exemplary embodiment, in each case two openings 15 are provided per side wall 7, 8, said openings being spaced apart from one another in the direction of the longitudinal extent of the respective channel 14. The horizontally running edges of the openings 15 at the top form the retaining elements 6, which counteract a lifting-off of the cover 2 in an upward direction (at least up to a certain lift-off force).

In the exemplary embodiment, the openings 15 extend as far as that edge of the first reinforcing portion 11 which adjoins the second reinforcing portion 12.

The first and second reinforcing portions 11, 12 form outwardly protruding flanges of the shell 1.

The cover 2 has a widened lower base portion which, by way of gradations 18, 19 of the side walls 3, 4, 16, 17, adjoins that part of the cover 2 which lies thereabove. In the state when the cover 2 has been placed onto the shell 1, the gradations 18 of the side walls 3, 4 having the nubs 5 rest on the first reinforcing portions 11 of the side walls 7, 8 of the shell 1.

The gradations 19 of the side walls 16, 17 of the cover 2 rest on the upper edges of the side walls 20, 21 of the shell 1, which extend between the side walls 7, 8 of the shell 1 having the channels 14.

Figure 14:
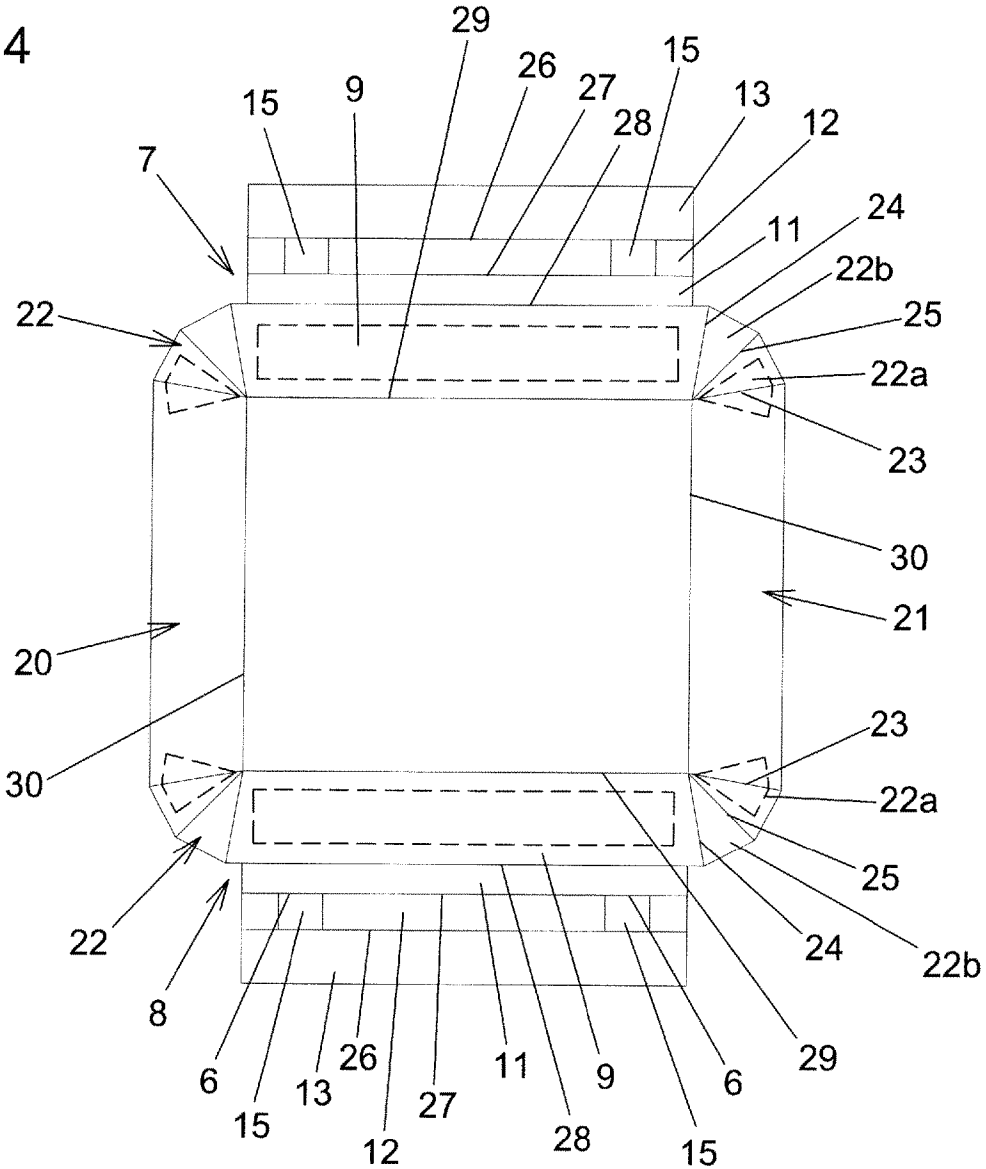
FIG. 14 shows a blank for forming the shell.

The shell 1 is formed from a blank which is made of cardboard or paperboard and which is illustrated in FIG. 14 in the state when it is flatly laid out on a planar substrate. Between the side walls 7, 21; 21, 8; 8, 20; 20, 7 which in each case succeed one another in the circumferential direction of the shell 1, there lies a respective connecting portion 22 by way of which the respectively successive side walls are connected to one another. A respective connecting portion 22 has a first and a second triangular portion 22*a*, 22*b*. The respective first triangular portion 22*a* is separated from the respectively adjacent side wall by way of a bending line 23 which proceeds from the respective corner. The respective second triangular portion 22*b* is separated from the respectively adjacent side wall by way of a bending line 24 which proceeds from the respective corner. The first and the second triangular portion 22*a*, 22*b* are in each case separated from one another by way of a bending line 25. Said bending line 25 proceeds from the respective corner of the bottom 10 and is at an angle of 135° with respect to the two side edges of the bottom which together form the corner. The bending line 25 subdivides the connecting portion 22 in such a way that two triangular portions 22*a*, 22*b* of equal size are formed.

In order to form the shell 1 from the blank, the triangular portions 22*a*, 22*b* of a respective connecting portion 22 are folded together, such that they preferably protrude toward the outside. In this case, the wall portions 9 of the side walls 7, 8 and the side walls 20, 21 are bent upward in relation to the bottom 10 about the bending lines 29, 30. Subsequently, the folded-together triangular portions 22*a*, 22*b* are in each case folded back toward one of the side walls 20, 21 and stuck thereto. The regions which are adhesively bonded to one another are indicated in FIG. 14 by way of dashed lines.

Subsequently, the adhesive-secured portions 13 are bent in relation to the second reinforcing portions 12 about the bending lines 26, the second reinforcing portions 12 are bent in relation to the first reinforcing portions 11 about the bending lines 27 and the first reinforcing portions are bent in relation to the wall portions 9 about the bending lines 28, and the adhesive-secured portions 13 are adhesively bonded to the outer sides of the wall portions 9. Those regions in which the adhesive-secured portions 13 are adhesively bonded to the wall portions 9 are indicated in FIG. 14 by way of dashed lines.

The bending lines 23-30 can be formed by way of crease lines or by way of perforation lines. By way of example, the bending lines 23, 26 can be configured as perforation lines and the remaining bending lines as crease lines.

Figure 15:
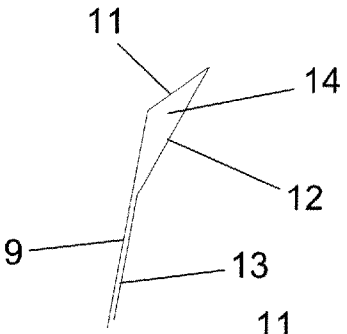
FIGS. 15, 16 and 17 show schematic depictions for the purposes of illustrating possible modifications of the configuration of the shell in the region of a side wall having a channel.
Figure 16:
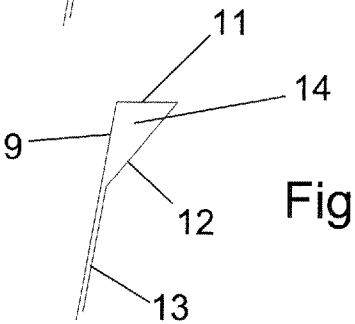
Figure 17:
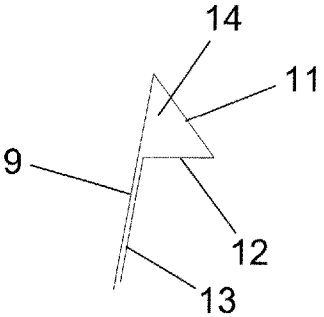

FIGS. 15 to 17 show various possible modifications of the angles between the wall portions 9, first reinforcing portions 11, second reinforcing portions 12 and adhesive-secured portions 13, with channels 14 which are triangular in cross section being formed in each case. The outer surfaces of the second reinforcing portions 12 each point in a downward direction at a more or less large angle with respect to the horizontal and can each be provided with openings, the edges of which form the retaining elements 6 for the nubs 5 of the cover 2.

Different modifications of the exemplary embodiments shown are conceivable and possible, without departing from the scope of the invention.

In principle, it would for example be conceivable and possible for the openings 15 in the second reinforcing portions 12 to be omitted, the downwardly directed outer surfaces of the second reinforcing portions 12 interacting with the nubs 5 in order to counteract a lifting-off of the cover 2 in an upward direction (at least up to a certain lift-off force). Such a configuration may be expedient in particular in the case of the configuration according to FIG. 16, in which the second reinforcing portion 12 is horizontal.

Openings in the second reinforcing portions 12 could also be configured in such a way that the cardboard or the paperboard is only incipiently cut over a part of the circumference of the opening, preferably over three sides, and, during the connection to the cover, is pressed inward by way of the nubs in the region of the opening. Preferably, the connection of the pressed-in portion to the remaining material of the blank remains at an edge at which in particular a bending line is formed. Therefore, for the purposes of forming the opening, a tab is pivoted inward (into the channel 14) about said bending line.

The second reinforcing portion 12 could also run obliquely in an upward direction proceeding from the connection thereof to the first reinforcing portion 11 as far as the wall portion 9. In such a configuration, the downwardly directed outer surfaces of the second reinforcing portions 12 can also form the retaining elements for the nubs 5.

The gradations 19 of the cover 2 could also be omitted.

The connecting portions 22 could also be configured differently. By way of example, one of the two adjoining side walls could have an attached flap (which lengthens the side wall), which, after the folding-out of the side walls, is folded back and adhesively bonded to the adjacent side wall on the outside.

As seen in plan view, the packaging could also have a shape other than a four-sided shape, for example a six-sided or eight-sided shape.

A packaging configured in accordance with the invention can also be provided for packaging objects other than food, for example for household objects.

LEGEND FOR THE REFERENCE NUMBERS

1 Shell
2 Cover
3 Side wall
4 Side wall
5 Nub
6 Retaining element
7 Side wall
8 Side wall
9 Wall portion
10 Bottom
11 First reinforcing portion
12 Second reinforcing portion
13 Adhesive-secured portion
14 Channel
15 Opening
16 Side wall
17 Side wall
18 Gradation
19 Gradation
20 Side wall
21 Side wall
22 Connecting portion
22*a* First triangular portion
22*b* Second triangular portion
23 Bending line
24 Bending line
25 Bending line
26 Bending line
27 Bending line
28 Bending line
29 Bending line
30 Bending line

The invention claimed is:

1. A packaging, comprising:

a shell made of cardboard or paperboard and having a bottom, side walls with retaining elements at at least two of the side walls, and an upper edge;

a cover which is placed onto the shell in a closed state of the packaging and which engages over an outside of the upper edge of the shell, the cover including cover side walls, and inwardly protruding nubs are arranged at at least two of the cover side walls, the inwardly protruding nubs interact with the retaining elements arranged at associated ones of the side walls of the shell;

the side walls of the shell which include the retaining elements each have a wall portion which is connected to the bottom of the shell by way of a bend, a first reinforcing portion connected to an upper end of the wall portion by way of a second bend, a second reinforcing portion connected to the first reinforcing portion by way of a third bend, and an adhesive-secured portion which is connected to the second reinforcing portion by way of a fourth bend and which is adhesively bonded to an outer side of the wall portion, a sub-portion of the wall portion that lies above the adhesive-secured portion, the first reinforcing portion and the second reinforcing portion delimiting a channel which is triangular in cross section; and the retaining elements for the nubs are formed by edges of openings in the second reinforcing portions or by the downwardly directed outer surfaces of the second reinforcing portions;

wherein the side walls which succeed one another in the circumferential direction of the shell are connected to one another by way of connecting portions which are adhesively bonded to at least one of the successive side walls, and the connecting portions each have a first and a second triangular portion, the first and the second triangular portion in each case are separated from an adjacent one of the side walls by a bend, which proceeds from a corner of the bottom at which the respective connecting portion is arranged, and the first and the second triangular portion are separated from one another by way of a further bend which proceeds from the corner of the bottom and which is at an angle of 135° with respect to the respective one of the two side edges of the bottom, in the flatly laid-out state, which together form the corner.

2. The packaging as claimed in claim 1, wherein the cover has a widened lower base portion which, by way of gradations of the side walls of the cover having the nubs, adjoins that part of the cover which lies thereabove, the gradations resting on the first reinforcing portions of the side walls of the shell.

3. The packaging as claimed in claim 1, wherein the inwardly protruding nubs are arranged at least at two opposing ones of the cover side walls, said nubs interacting with the retaining elements that are arranged at opposing ones of the side walls of the shell.

4. The packaging as claimed in claim 1, wherein an angle between the bottom of the shell and the respective wall portion, the upper end of which is connected to the respective first reinforcing portion by way of the respective second bend, lies in a range of 45° to 90°.

5. The packaging as claimed in claim 1, wherein an angle between the wall portion and the first reinforcing portion of the respective side wall lies in a range of 30° to 150°.

6. The packaging as claimed in claim 1, wherein an angle between the first and the second reinforcing portion of the respective side wall lies in a range of 20° to 120°.

7. The packaging as claimed in claim 1, wherein an angle between the second reinforcing portion and the adhesive-secured portion of the respective side wall lies in a range of 80° to 160°.

8. The packaging as claimed in claim 1, wherein the cover is comprised of plastic.

* * * * *